United States Patent [19]

Honkajärvi

[11] 4,306,618

[45] Dec. 22, 1981

[54] PIPE SPIRAL BUNDLE FOR A HEAT EXCHANGER

[75] Inventor: Markku V. Honkajärvi, Pori, Finland

[73] Assignee: Outokumpu Oy, Helsinki, Finland

[21] Appl. No.: 69,126

[22] Filed: Aug. 23, 1979

[30] Foreign Application Priority Data

Sep. 5, 1978 [FI] Finland ..... 782718

[51] Int. Cl.[3] ..... F28D 7/04

[52] U.S. Cl. ..... 165/163; 165/165

[58] Field of Search ..... 165/162, 163, 164, 165

[56] References Cited

U.S. PATENT DOCUMENTS

| | | | |
|---|---|---|---|
| 1,799,081 | 3/1931 | Blomquist | 165/164 |
| 2,129,300 | 9/1938 | Bichowsky | 165/163 |
| 2,523,990 | 9/1950 | Graham | 165/163 |
| 2,578,059 | 12/1951 | Graham | 165/162 |
| 2,653,014 | 9/1953 | Sniader | 165/164 |

FOREIGN PATENT DOCUMENTS

| | | | |
|---|---|---|---|
| 150147 | 9/1936 | Austria | 165/163 |
| 94992 | 12/1962 | Denmark | 165/163 |
| 1924630 | 11/1970 | Fed. Rep. of Germany | 165/163 |

*Primary Examiner*—Sheldon J. Richter

*Attorney, Agent, or Firm*—Brooks, Haidt, Haffner & Delahunty

[57] ABSTRACT

A pipe spiral bundle for a heat exchanger is produced by using pre-fabricated pipe spirals of the same shape, each pipe spirals having pipe loops essentially in one plane and at distances inside each other, such spirals being arranged concentrically and directly on top of each other and then tightly attached to each other so as to form a continuous spiral-shaped contact line between adjacent spirals, and a mutual branch pipe being connected to one end of each pipe spiral and a mutual collector pipe being connected to the opposite end of each pipe spiral. The pipe spirals may be heat welded to each other or connected to each other by mechanical binding members, such as metal bands.

2 Claims, 2 Drawing Figures

PIPE SPIRAL BUNDLE FOR A HEAT EXCHANGER

BACKGROUND OF THE INVENTION

1 Field of the Invention

The present invention relates to a pipe spiral bundle for a heat exchanger, having a number of plane pipe spirals of the same shape which have been arranged in parallel on the same central axis, the loops each single spiral lying inside the other, and spaced at a distance from each other, and all the spirals being connected, by one end of the same name, to a mutual branch pipe and by the other end to a mutual collector pipe. The invention also relates to a method for the manufacture of such a pipe spiral bundle.

2 Description of the Prior Art

Such heat exchangers are used, for example, for heating household water and in the heat distribution centers of central heating systems of apartment buildings. The use of heat exchangers is increasing along with the increased use of district heating.

A heat exchanger with a pipe spiral bundle of the type described above has been described in, for example, Swedish Pat. No. 400,368. In this heat exchanger the pipe spiral bundle is placed inside a cylindrical container, the branch and collector pipes protruding from one end of the container. The pipe bundle itself is assembled by fitting copper pipes of predetermined length side by side on a perforated steel plate to form a pipe mat, whereafter the mat is twisted into a spiral. The purpose of the steel plate is to direct the flow of district heating water or steam, which is fed in at the middle of the bundle and out from the mantle surface of the cylinder.

Since such copper pipe is usually delivered in the form of soft pipe on reels, the above, prior known manufacturing method requires that the pipe be first straightened and then re-bent when the pipe lengths have been fitted on a plate with extensions keeping the pipes in place at a distance from each other.

SUMMARY OF THE INVENTION

This invention provides a pipe spiral bundle of the character once described, which comprises a plurality of pre-bent pipe spirals, each having the same spiral shape with loops laying inside and at a distance from each other essentially in one plane;

the plurality of spirals being arranged on top of each other concentrically on the same central axis and tightly attached to each other so that a continuous spiral-shaped contact line is formed always between two adjacent spirals; a mutual branch pipe extending essentially transversally to the pipe spirals and connected to one end of each pipe spiral; and a mutual collector pipe also extending essentially transversally to the pipe spirals and connected to the opposite end of each pipe spiral.

The manufacturing method of this invention is characterized by pre-bending a plurality of pipes into one-plane spirals of the same shape, positioning the pipe spirals tightly on top of and concentrically with each other, attaching the spirals to each other so as to form continuous spiral-shaped contact lines between adjacent spirals, and connecting a collector branch pipe to one end of each spiral and a collecting pipe to the opposite end of each spiral.

It is an object of the present invention to achieve such an improvement over the known pipe spiral bundle that the manufacture thereof is simplified and the intermediate plate is not necessary.

Thus, according to the invention the pipe bundle of the heat exchanger is assembled from pre-bent regular pipe spirals, which are easy to manufacture from a hard pipe wound on a drawing reel and which can, in particular, be made directly using the machinery available in a pipe factory, so that both the pitch and the length of the loop can be regulated.

A tight attachment between the pipe spirals is achieved according to one advantageous embodiment of the invention by causing the spirals to become welded to each other at a high temperature.

Alternatively, the spirals can also be tied to each other by means of, for example, metal bands or other mechanical attaching members.

DESCRIPTION OF THE PREFERRED EMBODIMENT

Figure 1:
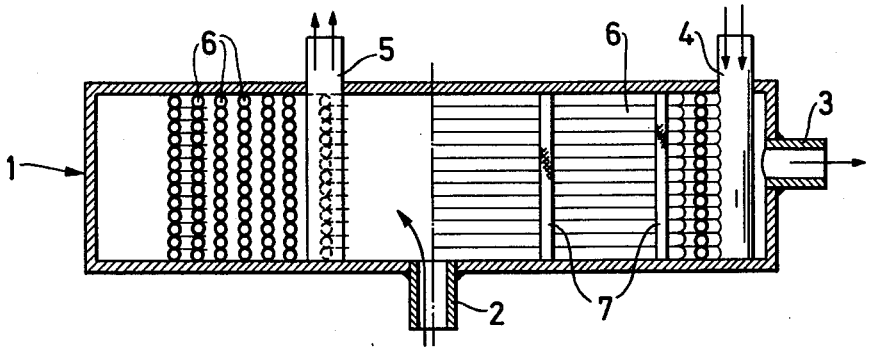
FIG. 1 depicts a side view, partly in section, of a heat exchanger provided with a pipe bundle according to the invention.
Figure 2:
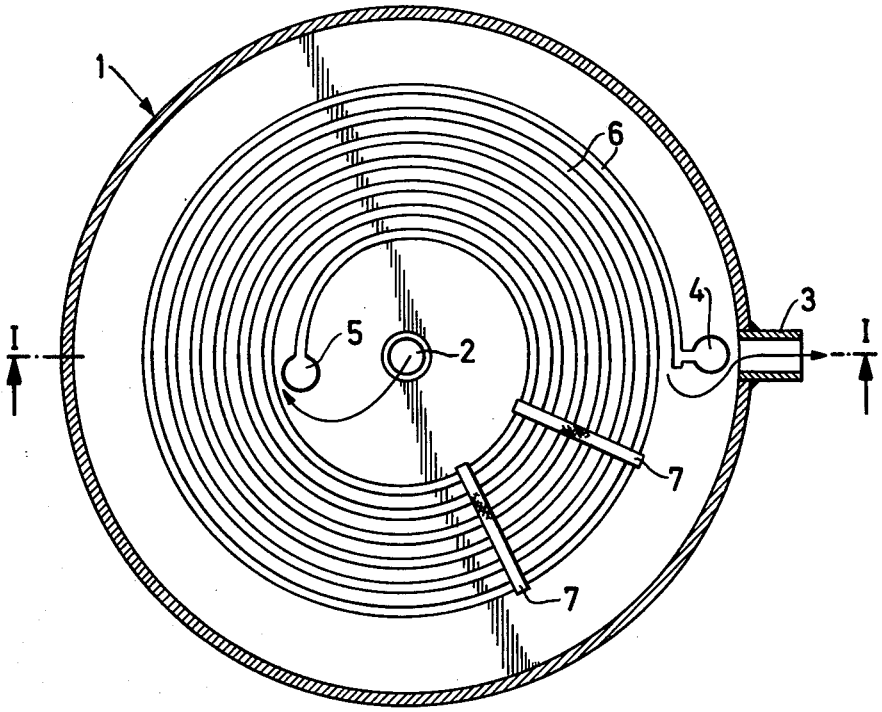
FIG. 2 depicts a plan view of the heat exchanger.

In the figures, numeral 1 indicates the cylindrical mantle of heat exchanger, provided with an inlet 2 and an outlet 3 for district heating water, as indicated by single arrows. The water to be heated, for example for use as household water or radiator water in an apartment building, comes from pipe 4 and passes into pipe 5, as indicated by double arrows. The pipe spirals are indicated by 6 and are placed tightly one on top of each other. In FIG. 1 the pipes 6 are shown unsectioned on the right-hand side and sectioned on the left-hand side. A branch pipe 4 is linked to their outer end and, respectively, their inner end is attached to a collector pipe 5.

The uninterrupted wall composed of the pipes 6 directs the flow of mantle water. No separate steel plate is required, and since the contact between the various pipes is a line, there is a large quantity of surface effective in terms of heat exchange. The size of the bundle is small in relation to its efficiency, and its shape is advantageous.

The pipe bundle can be assembled from spirals in several different ways, and at the same time the tightness of the wall composed of pipes can be affected. Possibly the least expensive and easiest method is to stack the spirals, which is supplied in a hard state, one on top of the other using auxiliary guides and then to bind them into bundles by metal bands. In the figures, two such bands are indicated by 7.

A second assembling method, substantially linked with the exploitation of the invention, is one in which especially the tightness and the strength of the pipe wall can be improved.

In this case the spirals have been stacked one on top of the other in a stacking frame, where guide pins center the loops at regular intervals and a straight pipe wall is produced. In addition, in this method the spirals can be pressed firmly against each other. Such a bundle is annealed until soft in a vacuum furnace at 500°–600° C., whereby the pipe spirals are welded or "sintered" to each other, and an uninterrupted and solid pipe wall is thereby obtained to direct the passage of the mantle water. In the soft-annealed state, the ends of the pipes can easily be shaped and linked to larger branch and collector pipes 4 and 5.

Good sintering requires an oxide-free and clean pipe surface. For this purpose, a hard-drawn pipe is suitable since the lubricant used in the drawing, adhering to the pipe surface, prevents oxidation. In a vacuum furnace the lubricant evaporates and the adhering takes place when the temperature rises. By compression loading, the pipe surfaces can be caused to press tightly against each other.

The strength of the wall can be improved further by using some soldering agent between the spirals during the annealing. For example, small tin shavings have been used in experiments. When melting in a vacuum the tin spreads along the linear contact surface, thereby producing a tight joint. Annealing in shield-gas furnaces of a certain type produces similar results.

What is claimed is:

1. A pipe spiral bundle for a heat exchanger, which comprises a plurality of pre-bend pipe spirals, each having the same spiral shape with loops laying inside and at a distance from each other essentially in one plane;

the plurality of spirals being arranged on top of each other concentrically on the same central axis and tightly attached to each other so that a continuous spiral-shaped contact line is formed always between two adjacent spirals, said adjacent spirals being sintered to each other along said contact line by annealing until soft in a vacuum furnace;

a mutual branch pipe extending essentially transversally to the pipe spirals and connected to one end of each pipe spiral; and a mutual collector pipe also extending essentially transversally to the pipe spirals and connected to the opposite end of each pipe spiral.

2. A spiral bundle according to claim 1, wherein the pipe spirals are hard-drawn copper pipe.

* * * * *